US007117154B2

(12) United States Patent
Yoshioka et al.

(10) Patent No.: US 7,117,154 B2
(45) Date of Patent: Oct. 3, 2006

(54) CONVERTING APPARATUS OF VOICE SIGNAL BY MODULATION OF FREQUENCIES AND AMPLITUDES OF SINUSOIDAL WAVE COMPONENTS

(75) Inventors: Yasuo Yoshioka, Hamamatsu (JP); Xavier Serra, Barcelona (ES)

(73) Assignees: Yamaha Corporation, Hamamatsu (JP); Pompeu Fabra University, Barcelona (ES)

( * ) Notice: Subject to any disclaimer, the term of this patent is extended or adjusted under 35 U.S.C. 154(b) by 0 days.

(21) Appl. No.: 09/181,021

(22) Filed: Oct. 27, 1998

(65) Prior Publication Data

US 2001/0044721 A1 Nov. 22, 2001

(30) Foreign Application Priority Data

Oct. 28, 1997 (JP) ..... 9-296050

(51) Int. Cl.
*G10L 13/00* (2006.01)
*G10H 7/00* (2006.01)

(52) U.S. Cl. ..... 704/258; 704/268; 84/604

(58) Field of Classification Search ..... 704/258, 704/268, 270, 272, 278, 207, 205; 84/610, 84/634, 604; 434/307 A
See application file for complete search history.

(56) References Cited

U.S. PATENT DOCUMENTS 4,797,926 A * 1/1989 Bronson et al. ..... 704/214
5,504,270 A * 4/1996 Sethares ..... 84/645
5,536,902 A * 7/1996 Serra et al. ..... 84/623
5,567,901 A * 10/1996 Gibson et al. ..... 84/603
5,621,182 A * 4/1997 Matsumoto ..... 84/610
5,644,677 A * 7/1997 Park et al. ..... 704/207
5,749,073 A * 5/1998 Slaney ..... 704/278
5,847,303 A * 12/1998 Matsumoto ..... 84/610
5,862,232 A * 1/1999 Shinbara et al. ..... 381/61
5,955,693 A * 9/1999 Kageyama ..... 84/610
5,963,907 A * 10/1999 Matsumoto ..... 704/270
5,966,687 A * 10/1999 Ojard ..... 704/207
6,046,395 A * 4/2000 Gibson et al. ..... 84/603
6,182,042 B1 * 1/2001 Peevers ..... 704/269

FOREIGN PATENT DOCUMENTS

| | | |
|---|---|---|
| JP | H2-59477 | 12/1990 |
| JP | 03-026468 | 3/1991 |
| JP | 07-056598 | 3/1995 |
| JP | 08-263077 | 10/1996 |
| JP | 09-185392 | 7/1997 |
| WO | 94-22130 | 9/1994 |

* cited by examiner

*Primary Examiner*—Angela Armstrong
(74) *Attorney, Agent, or Firm*—Pillsbury Winthrop Shaw Pittman LLP

(57) ABSTRACT

A voice converter synthesizes an output voice signal from an input voice signal and a reference voice signal. In the voice converter, an analyzer device analyzes a plurality of sinusoidal wave components contained in the input voice signal to derive a parameter set of an original frequency and an original amplitude representing each sinusoidal wave component. A source device provides reference information characteristic of the reference voice signal. A modulator device modulates the parameter set of each sinusoidal wave component according to the reference information. A regenerator device operates according to each of the parameter sets as modulated to regenerate each of the sinusoidal wave components so that at least one of the frequency and the amplitude of each sinusoidal wave component as regenerated varies from original one, and mixes the regenerated sinusoidal wave components altogether to synthesize the output voice signal.

46 Claims, 6 Drawing Sheets

CONVERTING APPARATUS OF VOICE SIGNAL BY MODULATION OF FREQUENCIES AND AMPLITUDES OF SINUSOIDAL WAVE COMPONENTS

BACKGROUND OF THE INVENTION

1. Field of the Invention

The present invention relates to a voice converter which causes a processed voice to imitate a further voice forming a target.

2. Description of the Related Art

Various voice converters which change the frequency characteristics, or the like, of an input voice and then output the voice, have been disclosed. For example, there exist karaoke apparatuses which change the pitch of the singing voice of a singer to convert a male voice to a female voice, or vice versa (for example, Publication of a Translation of an International Application No. Hei. 8-508581 and corresponding international publication WO94/22130).

However, in a conventional voice converter, although the voice is converted, this has simply involved changing the voice characteristics. Therefore, it has not been possible to convert the voice such that it approximates someone's voice, for example. Moreover, it would be very amusing if a karaoke machine were provided with an imitating function whereby not only the voice characteristics, but also the manner of singing, could be made to sound like a particular singer. However, in conventional voice converters, processing of this kind has not been possible.

SUMMARY OF THE INVENTION

The present invention is devised with the foregoing in view, an object thereof being to provide a voice converter which is capable of making voice characteristics imitate a target voice. It is a further object of the present invention to provide a voice converter which is capable of making an input voice of a singer imitate the singing manner of a desired singel In order to resolve the aforementioned problems, according to one aspect, the inventive apparatus is constructed for converting an input voice signal into an output voice signal according to a reference voice signal. The inventive apparatus comprises extracting means for extracting a plurality of sinusoidal wave components from the input voice signal, memory means for memorizing pitch information representative of a pitch of the reference voice signal, modulating means for modulating a frequency of each sinusoidal wave component according to the pitch information retrieved from the memory means, and mixing means for mixing the plurality of the sinusoidal wave components having the modulated frequencies to synthesize the output voice signal having a pitch different from that of the input voice signal and influenced by that of the reference voice signal.

Preferably, the inventive apparatus further comprises control means for setting a control parameter effective to control a degree of modulation of the frequency of each sinusoidal wave component by the modulating means so that a degree of influence of the pitch of the reference voice signal to the pitch of the output voice signal is determined according to the control parameter.

Preferably, the memory means comprises means for memorizing primary pitch information representative of a discrete pitch matching a music scale, and secondary pitch information representative of a fractional pitch fluctuating relative to the discrete pitch, and the modulating means comprises means for modulating the frequency of each sinusoidal wave component according to both of the primary pitch information and the secondary pitch information.

Preferably, the inventive apparatus further comprises detecting means for detecting a pitch of the input voice signal based on results of extraction of the sinusoidal wave components, and switch means operative when the detecting means does not detect the pitch from the input voice signal for outputting an original of the input voice signal in place of the synthesized output voice signal.

Preferably, the memory means further comprises means for memorizing amplitude information representative of amplitudes of sinusoidal wave components contained in the reference voice signal, and the modulating means further comprises means for modulating an amplitude of each sinusoidal wave component of the input voice signal according to the amplitude information, so that the mixing means mixes the plurality of the sinusoidal wave components having the modulated amplitudes to synthesize the output voice signal having a timbre different from that of the input voice signal and influenced by that of the reference voice signal.

Preferably, the inventive apparatus further comprises means for setting a control parameter effective to control a degree of modulation of the amplitude of each sinusoidal wave component by the modulating means so that a degree of influence of the timbre of the reference voice signal to the timbre of the output voice signal is determined according to the control parameter.

Preferably, the inventive apparatus further comprises means for memorizing volume information representative of a volume variation of the reference voice signal, and means for varying a volume of the output voice signal according to the volume information so that the output voice signal emulates the volume variation of the reference voice signal.

Preferably, the inventive apparatus further comprises means for separating a residual component from the input voice signal after extraction of the sinusoidal wave components, and means for adding the residual component to the output voice signal.

In another aspect, the inventive apparatus is constructed for converting an input voice signal into an output voice signal according to a reference voice signal. The inventive apparatus comprises extracting means for extracting a plurality of sinusoidal wave components from the input voice signal, memory means for memorizing amplitude information representative of amplitudes of sinusoidal wave components contained in the reference voice signal, modulating means for modulating an amplitude of each sinusoidal wave component extracted from the input voice signal according to the amplitude information retrieved from the memory means, and mixing means for mixing the plurality of the sinusoidal wave components having the modulated amplitudes to synthesize the output voice signal having a timbre different from that of the input voice signal and influenced by that of the reference voice signal.

Preferably, the inventive apparatus further comprises control means for setting a control parameter effective to control a degree of modulation of the amplitude of each sinusoidal wave component by the modulating means so that a degree of influence of the timbre of the reference voice signal to the timbre of the output voice signal is determined according to the control parameter.

Preferably, the memory means further memorizes pitch information representative of a pitch of the reference voice signal, and the modulating means further modulates a frequency of each sinusoidal wave component of the input voice signal according to the pitch information, so that the mixing means mixes the plurality of the sinusoidal wave components having the modulated frequencies to synthesize the output voice signal having a pitch different from that of the input voice signal and influenced by that of the reference voice signal.

Preferably, the inventive apparatus further comprises means for setting a control parameter effective to control a degree of modulation of the frequency of each sinusoidal wave component by the modulating means so that a degree of influence of the pitch of the reference voice signal to the pitch of the output voice signal is determined according to the control parameter.

Preferably, the memory means comprises means for memorizing primary pitch information representative of a discrete pitch matching a music scale, and secondary pitch information representative of a fractional pitch fluctuating relative to the discrete pitch, and the modulating means comprises means for modulating the frequency of each sinusoidal wave component according to both of the primary pitch information and the secondary pitch information.

Preferably, the inventive apparatus further comprises detecting means for detecting a pitch of the input voice signal based on results of extraction of the sinusoidal wave components, and switch means operative when the detecting means does not detect the pitch from the input voice signal for outputting an original of the input voice signal in place of the synthesized output voice signal.

Preferably, the inventive apparatus further comprises means for memorizing volume information representative of a volume variation of the reference voice signal, and means for varying a volume of the output voice signal according to the volume information so that the output voice signal emulates the volume variation of the reference voice signal.

Preferably, the inventive apparatus further comprises means for separating a residual component from the input voice signal after extraction of the sinusoidal wave components, and means for adding the residual component to the output voice signal.

DESCRIPTION OF THE PREFERRED EMBODIMENTS

Figure 1:
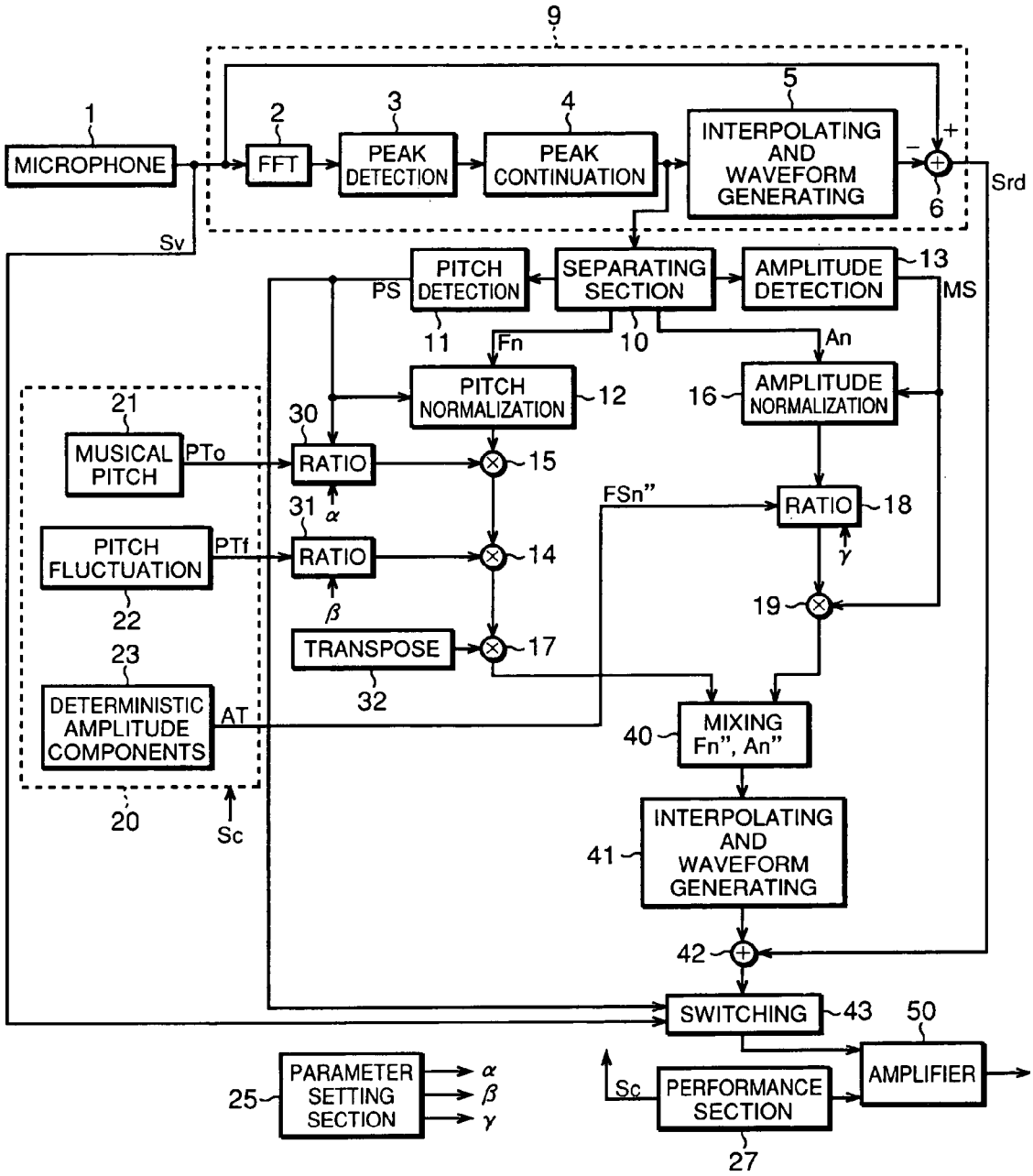
FIG. 1 is a block diagram showing the composition of one embodiment of the present invention.

Next, an embodiment of the present invention is described. FIG. 1 is a block diagram showing the composition of an embodiment of the present invention. This embodiment relates to a case where a voice converter according to the present invention is applied to a karaoke machine, whereby imitations of a professional singer by a karaoke player can be performed.

Firstly, the principles of this embodiment are described. Initially, a song by an original or professional singer who is to be imitated is analyzed, and the pitch thereof and the amplitude of sinusoidal wave components therein are recorded. Sinusoidal wave components are then extracted from a current singer's voice, and the pitch and the amplitude of the sinusoidal wave components in the voice being imitated are used to affect or modify these sinusoidal wave components extracted from the current singer's voice. The affected sinusoidal wave components are synthesized to form a synthetic waveform, which is amplified and output. Moreover, the degree to which the wave components are affected can be adjusted by a prescribed control parameter. By means of the aforementioned processing, a voice waveform which reflects the voice characteristics and singing manner of the original or professional singer to be imitated is formed, and this waveform is output whilst a karaoke performance is conducted for the current singer.

Figure 2:
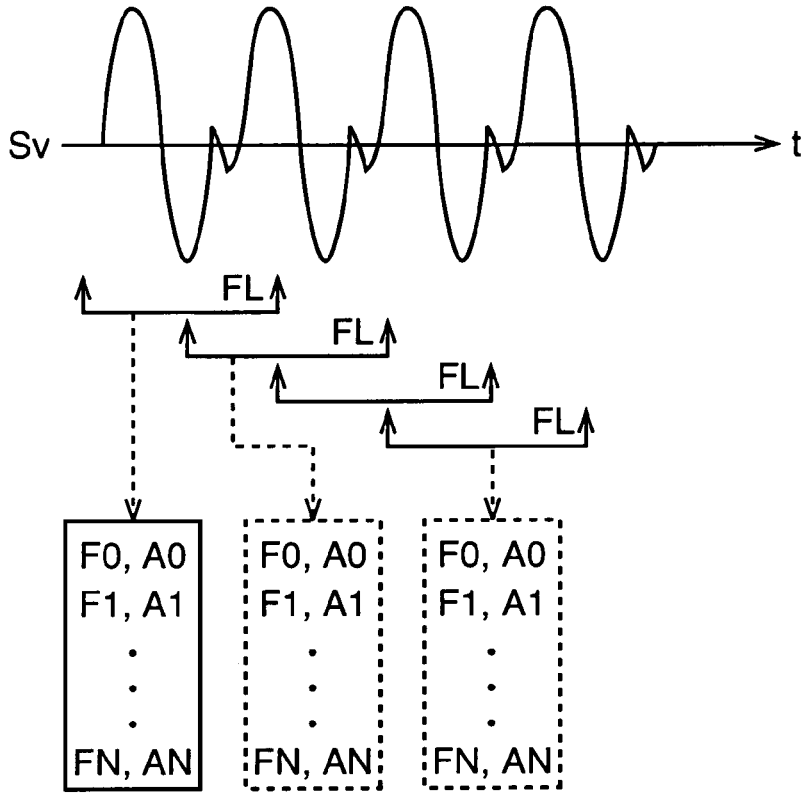
FIG. 2 is a diagram showing frame states of input voice signal according to the embodiment.

In FIG. 1, numeral 1 denotes a microphone, which gathers the singer's voice and provides an input voice signal Sv. This input voice signal Sv is then analyzed by a Fast Fourier Transform section 2, and the frequency spectrum thereof is detected. The processing implemented by the Fast Fourier Transform section 2 is carried out in prescribed frame units, so a frequency spectrum is created successively for each frame. FIG. 2 shows the relationship between the input voice signal Sv and the frames thereof. Symbol FL denotes a frame, and in this embodiment, each frame FL is set such that it overlaps partially with the previous frame FL.

Figure 3:
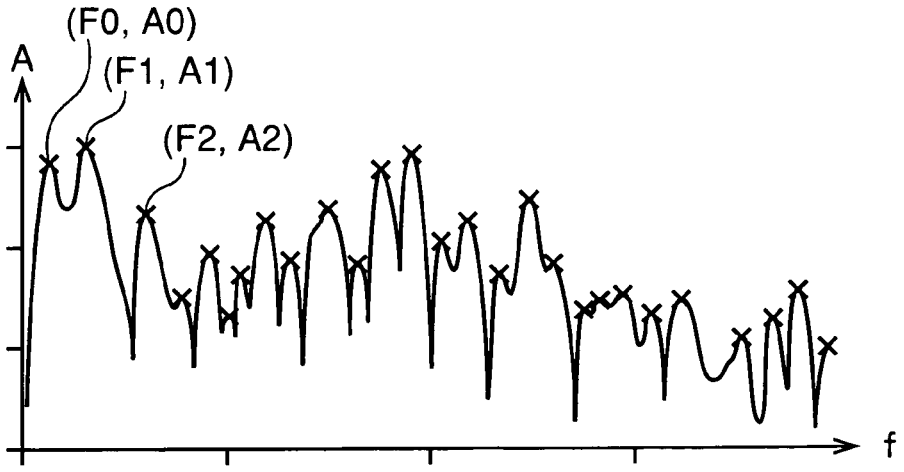
FIG. 3 is an illustrative diagram for describing the detection of frequency spectrum peaks according to the embodiment.
Figure 4:
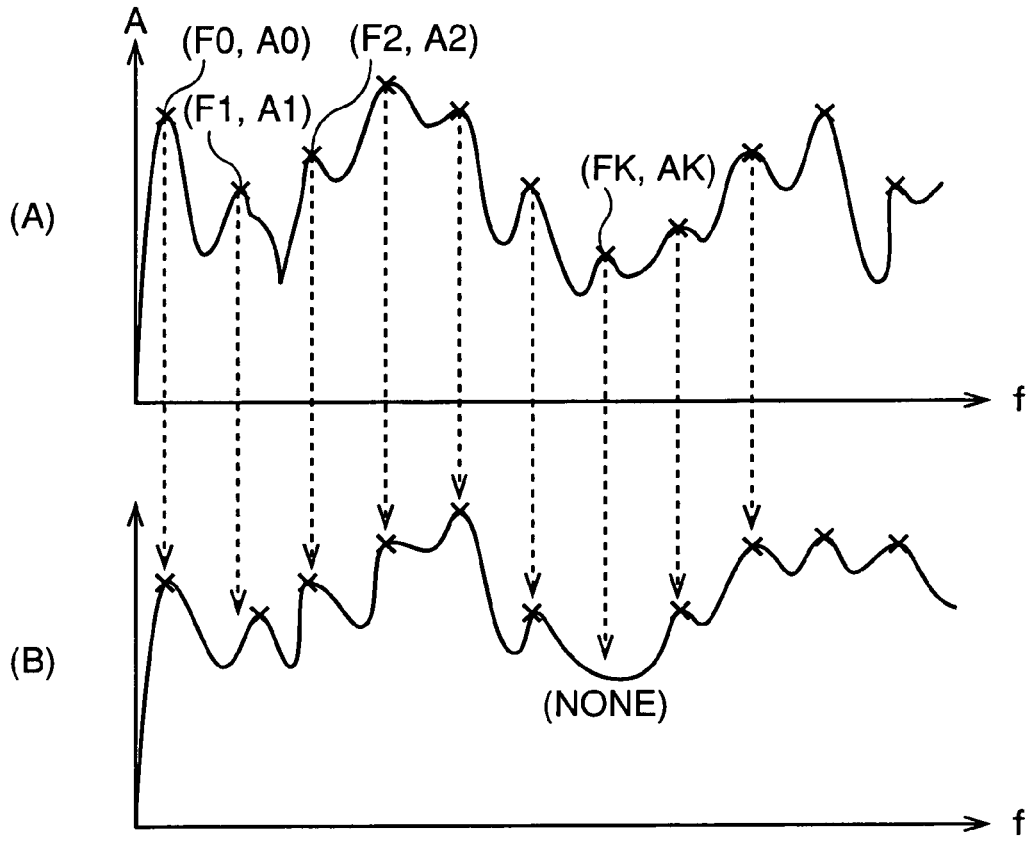
FIG. 4 is a diagram illustrating the continuation of peak values between frames according to the embodiment.

Numeral 3 denotes a peak detecting section for detecting peaks in the frequency spectrum of the input voice signal Sv. For example, the peak values marked by the X symbols are detected in the frequency spectrum illustrated in FIG. 3. A parameter set of such peak values is output for each frame in the form of frequency value F and amplitude value A co-ordinates, such as (F0,A0), (F1,A1), (F2,A2), . . . (FN, AN). FIG. 2 gives a schematic view of parameter sets of peak values for each frame. Next, a peak continuation section 4 determines continuation between the previous and subsequent frames for the parameter sets of peak values output by the peak detecting section 3 at each frame. Peak values considered to form continuation are subjected to continuation processing such that a data series is created. Here, the continuation processing is described with reference to FIG. 4. The peak values shown in section (A) of FIG. 4 are detected in the previous frame, and the peak values shown in section (B) of FIG. 4 are detected in the subsequent frame. In this case, the peak continuation section 4 investigates whether peak values corresponding to each of the peak values detected in the preceding frame, (F0,A0), (F1,A1), (F2,A2), . . . (FN,AN), are also detected in the current frame. It determines whether the corresponding peak values are present according to whether or not a peak is currently detected within a prescribed range about the frequencies of the peak values detected in the preceding frame. In the example in FIG. 4, peak values corresponding to (F0,A0), (F1,A1), (F2,A2), . . . . . are discovered, but a peak value corresponding to (FK,AK) is not observed.

Figure 5:
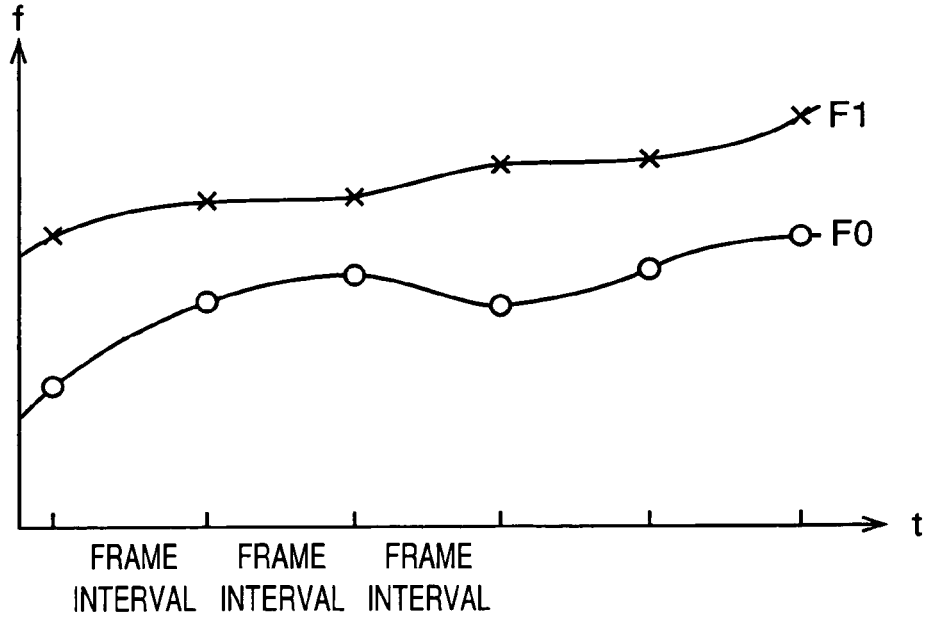
FIG. 5 is a diagram showing the state of change in frequency values according to the embodiment.

If the peak continuation section 4 discovers corresponding peak values, then they are coupled in time series order and are output as a data series of sets. If it does not find a corresponding peak value, then the peak value is overwritten by data indicating that there is no corresponding peak for that frame. FIG. 5 shows one example of change in peak frequencies F0 and F1. Change of this kind also occurs in the amplitudes A0, A1, A2, . . . . In this case, the data series output by the peak continuation section 4 contains scattered or discrete values output at each frame interval. The peak values output by the peak continuation section 4 are called deterministic components thereafter. This signifies that they are components of the original input voice signal Sv and can be rewritten definitely as sinusoidal wave elements. Each of the sinusoidal waves (precisely, the amplitude and frequency which are the parameter set of the sinusoidal wave) are called partial components.

Next, an interpolating and waveform generating section 5 carries out interpolation processing with respect to the deterministic components output from the peak continuation section 4, and it generates the sinusoidal waves corresponding to the deterministic components after interpolation. In this case, the interpolation is carried out at intervals corresponding to the sampling rate (for example, 44.1 kHz) of a final output voice signal (signal immediately prior to input to an amplifier 50 described hereinafter). The solid lines shown on FIG. 5 illustrate a case where the interpolation processing is carried out with respect to peak values F0 and F1.

Figure 7:
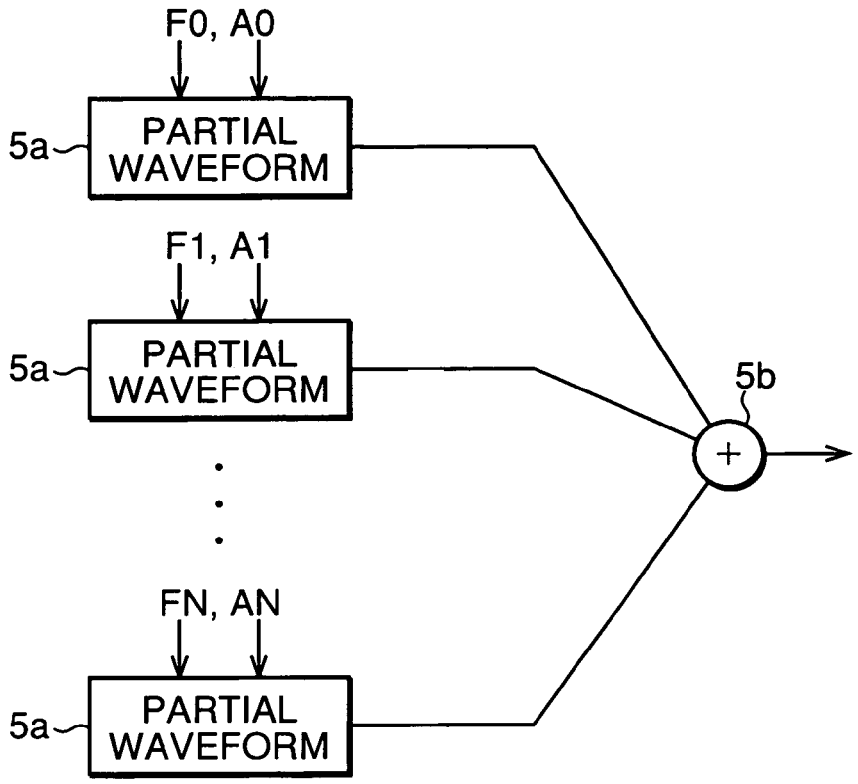
FIG. 7 is a block diagram showing the composition of an interpolating and waveform generating section according to the embodiment.

Here, FIG. 7 shows the composition of the interpolating and waveform generating section 5. The elements 5*a*, 5*a* , . . . shown in this diagram are respective partial waveform generating sections, which generate sinusoidal waves corresponding to the specified frequency values and amplitude values. Here, the deterministic components (F0, A0), (F1,A1), (F2,F3), . . . in the present embodiment change from moment to moment in accordance with the respective interpolations, so the waveforms output from the partial waveform generating sections 5*a*, 5*a*, . . . follow these changes. In other words, since the deterministic components (F0,A0), (F1,A1), (F2,A2), . . . are output successively by the peak continuation section 4, and are each subjected to the interpolation, each of the partial waveform generating sections 5*a*, 5*a*, . . . outputs a sinusoidal waveform whose frequency and amplitude fluctuates within a prescribed range. The waveforms output by the respective partial waveform generating sections 5*a*, 5*a*, . . . are added and synthesized at an adding section 5*b*. Therefore, the synthetic voice signal from the interpolating and waveform generating section 5 has only the deterministic components which have been extracted from the original input voice signal Sv.

Next, a deviation detecting section 6 shown in FIG. 1 calculates the deviation between the synthetic voice signal exclusively composed of the deterministic wave components output by the interpolating and waveform generating section 5 and the original input voice signal Sv. Hereinafter, the deviation components are called residual components Srd. The residual components Srd comprise a large number of voiceless components such as noises and consonants contained in the singing voice of the karaoke player . The aforementioned deterministic components, on the other hand, correspond to voiced components. When imitating someone's voice, only the voiced components need to be processed and there is no particular need to process the voiceless components. Therefore, in this embodiment, voice conversion processing is carried out only with respect to the deterministic components corresponding to the voiced components.

Next, numeral 10 shown in FIG. 1 denotes a separating section, where the frequency values F0–FN and the amplitude values A0–AN are separated from the data series output by the peak continuation section 4. The pitch detecting section 11 detects the pitch of the original input voice signal at each frame on the basis of the frequency values or the deterministic components supplied by the separating section 10. In the pitch detection process, a prescribed number of (for example, approximately three) frequency values are selected from the lowest of the frequency values output by the separating section 10, prescribed weighting is applied to these frequency values, and the average thereof is calculated to give a pitch PS. Furthermore, for frames in which a pitch cannot be detected, the pitch detecting section 11 outputs a signal indicating that there is no pitch. A frame containing no pitch occurs in cases where the input voice signal Sv in the frame is constituted almost entirely by voiceless or unvoiced components and noises. In frames of this kind, since the frequency spectrum does not form a harmonic structure, it is determined that there is no pitch.

Next, numeral 20 denotes a target information storing section wherein reference information relating to the object whose voice is to be imitated or emulated (hereinafter, called the target) is stored. The target information storing section 20 holds the reference or target information on the target for separate karaoke songs. The target information comprises pitch information PTo representing a discrete musical pitch of the target voice, a pitch fluctuation component or fractional pitch information PTf, and amplitude information representing deterministic amplitude components (corresponding to the amplitude values A0, A1, A2, . . . output by the separating section 10.) These information elements are stored respectively in a musical pitch storing section 21, a fluctuation pitch storing section 22 and a deterministic amplitude component storing section 23. The target information storing section 20 is composed such that the respective items of information described above are read out in synchronism with the karaoke performance. The karaoke performance is implemented in a performance section 27 illustrated in FIG. 1. Song data for use in karaoke is previously stored in the performance section 27. Request song data selected by a user control (omitted from diagram) is read out successively as the music proceeds, and is supplied to an amplifier 50. In this case, the performance section 27 supplies a control signal Sc indicating the song title and the state of progress of the song to the target information storing section 20, which proceeds to read out the aforementioned target information elements on the basis of this control signal Sc.

Next, the pitch information PTo of the target or reference voice read out from the musical pitch storing section 21 is mixed with the pitch PS of the input voice signal in a ratio control section 30. This mixing is carried out on the basis of the following equation.

$$(1.0-\alpha)*PS+\alpha*PTo$$

Here, $\alpha$ is a control parameter which may take a value from 0 to 1. The signal output from the ratio control section 30 is equal to pitch PS when $\alpha=0$, and it is equal to pitch information PTo when $\alpha=1$. Furthermore, the parameter $\alpha$ is set to a desired value by means of a user control of a parameter setting section 25. The parameter setting section 25 can also be used to set control parameters β and γ, which are described hereinafter.

Next, a pitch normalizing section 12 as illustrated in FIG. 1 divides each of the frequency values F0–FN output from the separating section 10 by the pitch PS, thereby normalizing the frequency values. Each of the normalized frequency values F0/PS–FN/PS (dimensionless) is multiplied by the signal from the ratio control section 30 by means of a multiplier 15, and the dimension thereof becomes frequency once again. In this case, it is determined from the value of the parameter α whether the pitch of the singer inputting his or her voice via the microphone 1 has a larger effect or whether the target pitch has a larger effect.

Another ratio control section 31 multiplies the fluctuation component PTf output from the fluctuation pitch storing section 22 by the parameter β (where $0 \leqq \beta \leqq 1$), and outputs the result to a multiplier 14. In this case, the fluctuation component PTf indicates the divergence relating to the pitch information PTo in cent units. Therefore, the fluctuation component PTf is divided by 1200 (1 octave is 1200 cents) in the ratio control section 31, and calculation for finding the second power thereof is carried out, namely, the following calculation:

$$POW(2,(PTf*\beta/1200))$$

The calculation results and the output signal from the multiplier 15 is multiplied with each other by the multiplier 14. The output signal from the multiplier 14 is further multiplied by the output signal of a transposition control section 32 at a multiplier 17. The transposition control section 32 outputs values corresponding to the musical interval through which transposition is performed. The degree of transposition is set as desired. Normally, it is set to no transposition, or a change in octave units is specified. A change in octave units is specified in cases where there is an octave difference in the musical intervals being sung, for instance, where the target is male and the karaoke singer is female (or vice versa). As described above, the target pitch and fluctuation component are appended to the frequency values output from the pitch normalizing section 12, and if necessary, octave transposition is carried out, whereupon the signal is input to a mixer 40.

Next, numeral 13 illustrated in FIG. 1 denotes an amplitude detecting section, which detects the mean value MS of the amplitude values A0, A1, A2, . . . supplied by the separating section 10 at each frame. In an amplitude normalizing section 16, the amplitudes values A0, A1, A2 are normalized by dividing them by this mean value MS. In a ratio control section 18, the deterministic amplitude components AT0, AT1, AT2 . . . (normalized) which are read out from the deterministic amplitude component storing section 23, are mixed with the aforementioned normalized amplitude values. The degree of mixing is determined by the parameter γ. If the deterministic amplitude components AT0, AT1, AT2, . . . are represented by ATn (n=1, 2, 3, . . . ), and the amplitude values output by the amplitude normalizing section 16 are represented by ASn' (n=1, 2, 3, . . . ), then the operation of the ratio control section 18 can be expressed by the following calculation.

$$(1-\gamma)*ASn'+\gamma*ATn$$

The parameter γ is set as appropriate in the parameter setting section 25, and it takes a value from zero to one. The larger the value of γ, the greater the effect of the target. Since the amplitude of the sinusoidal wave components in the voice signal determines voice characteristics, the voice becomes closer to the characteristics of the target, the larger the value of γ. The output signal from the ratio control section 18 is multiplied by the mean value MS in a multiplier 19. In other words, it is converted from a normalized signal to a signal which represents the amplitude directly.

Next, in the mixer 40, the amplitude values and the frequency values are combined. This combined signal comprises the deterministic components of the voice signal Sv of the karaoke singer, with the deterministic components of the target voice added thereto. Depending on the values of the parameters α, β and γ, 100% target-side deterministic components can be obtained for the output voice signal. These deterministic components (group of partial components which are sinusoidal waves) are supplied to an interpolating and waveform generating section 41. The interpolating and waveform generating section 41 is constituted similarly to the aforementioned interpolating and waveform generating section 5 (see FIG. 7). The interpolating and waveform generating section 41 interpolates the partial components or the deterministic components output from the mixer 40, and it generates partial sinusoidal waveforms on the basis of these respective partial components after the interpolation, and synthesizes these partial waveforms to form the output voice signal. The synthesized waveforms are added to the residual component Srd at an adder 42, and are then supplied via a switching section 43 to the amplifier 50. In frames where no pitch can be detected by the pitch detecting section 11, the switching section 43 supplies the amplifier 50 with the input voice signal Sv of the singer instead of the synthesized voice signal output from the adder 42. This is because, since the aforementioned processing is not required for noise or voiceless voice, it is preferable to output the original voice signal directly.

As described above, the inventive voice converting apparatus synthesizes the output voice signal from the input voice signal Sv and the reference or target voice signal. In the inventive apparatus, an analyzer device 9 comprised of the FFT 2, peak detecting section 3, peak continuation section 4 and other sections analyzes a plurality of sinusoidal wave components contained in the input voice signal Sv to derive a parameter set (Fn,An) of an original frequency and an original amplitude representing each sinusoidal wave component. A source device composed of the target information memory section 20 provides reference information (Pto, PTf and AT) characteristic of the reference voice signal. A modulator device including the arithmetic sections 12, 14–19 and 30–32 modulates the parameter set (Fn,An) of each sinusoidal wave component according to the reference information (Pto, PTf and AT). A regenerator device composed of the interpolation and waveform generating section 41 operates according to each of the parameter sets (Fn," An") as modulated to regenerate each of the sinusoidal wave components so that at least one of the frequency and the amplitude of each sinusoidal wave component as regenerated varies from original one, and mixes the regenerated sinusoidal wave components altogether to synthesize the output voice signal.

Specifically, the source device provides the reference information (PTo and PTf) characteristic of a pitch of the reference voice signal. The modulator device modulates the parameter set of each sinusoidal wave component according to the reference information so that the frequency of each sinusoidal wave component as regenerated varies from the original frequency. By such a manner, the pitch of the output voice signal is synthesized according to the pitch of the reference voice signal. Further, the source device provides the reference information characteristic of both of a discrete pitch PTo matching a music scale and a fractional pitch PTf fluctuating relative to the discrete pitch. By such a manner, the pitch of the output voice signal is synthesized according to both of the discrete pitch and the fractional pitch of the reference voice signal.

Further, the source device provides the reference information AT characteristic of a timbre of the reference voice signal. The modulator device modulates the parameter set of each sinusoidal wave component according to the reference information AT so that the amplitude of each sinusoidal wave component as regenerated varies from the original amplitude. By such a manner, the timbre of the output voice signal is synthesized according to the timbre of the reference voice signal.

The inventive voice converting apparatus includes a control device in the form of the parameter setting section 25 that provides a control parameter (α, β and γ) effective to control the modulator device so that a degree of modulation of the parameter set (Fn and An) is variably determined according to the control parameter. The inventive apparatus further includes a detector device in the form of the pitch detecting section 11 that detects a pitch PS of the input voice signal Sv based on analysis of the sinusoidal wave components by the analyzer device 9, and a switch device in the form of the switching section 43 operative when the detector device does not detect the pitch PS from the input voice signal Sv for outputting an original of the input voice signal Sv in place of the synthesized output voice signal. Still further, the inventive apparatus includes a memory device in the form of a volume data section 60 (described later in detail with reference to FIG. 8) that memorizes volume information representative of a volume variation of the reference voice signal, and a volume device composed of a multiplier 62 (described later in detail with reference to FIG. 8) that varies a volume of the output voice signal according to the volume information so that the output voice signal emulates or imitate the volume variation of the reference voice signal. Moreover, the inventive apparatus includes a separator device in the form of the residual detecting section 6 that separates a residual component Sdr other than the sinusoidal wave components from the input voice signal, and an adder device composed of the adder 42 that adds the residual component Sdr to the output voice signal.

Figure 6:
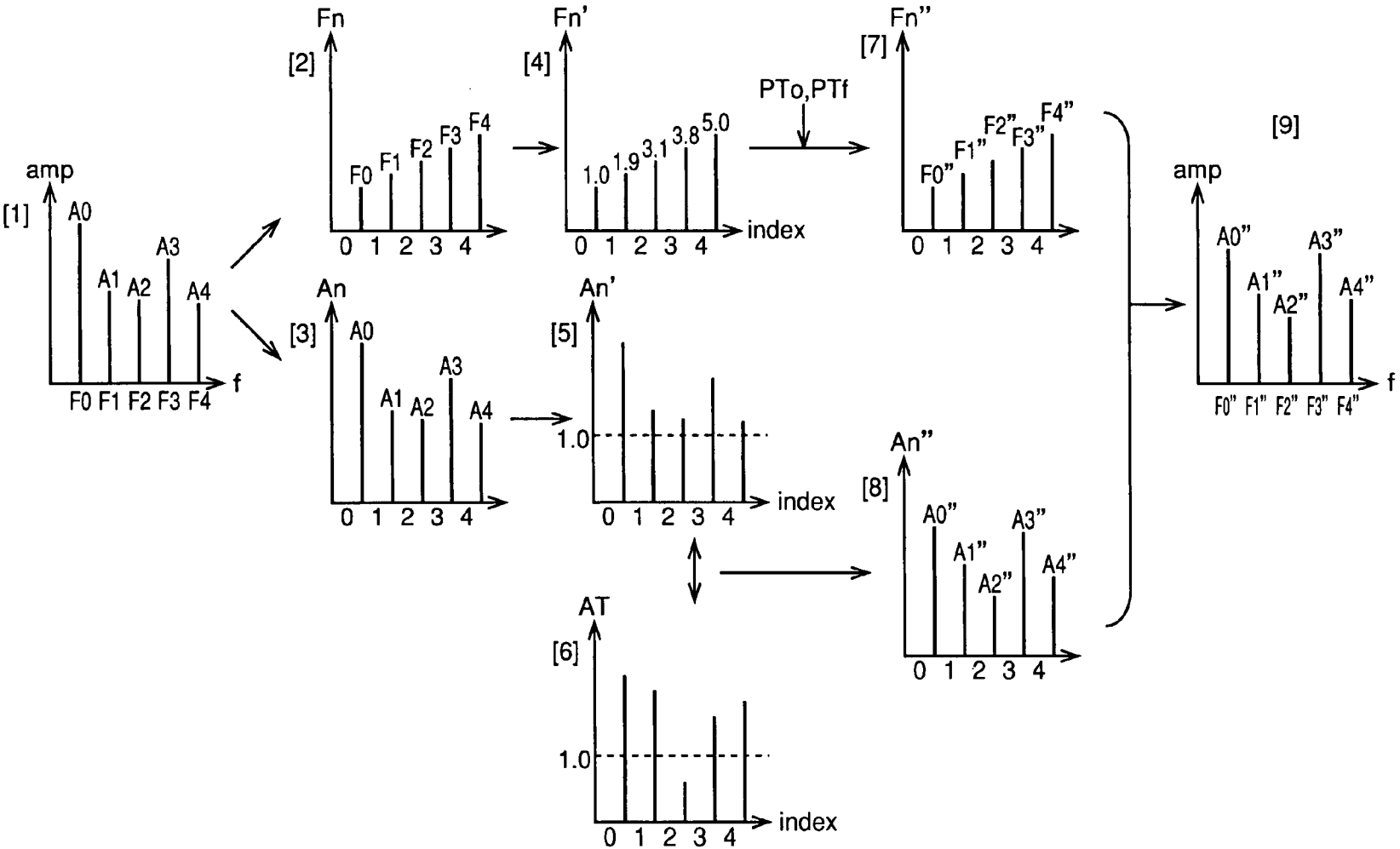
FIG. 6 is a graph showing the state of change of deterministic components during processing according to the embodiment.

Next, the operation of the embodiment having the foregoing composition is described. Firstly, when a karaoke song is specified, the song data for that karaoke song is read out by the performance section 27, and a musical accompaniment sound signal is created on the basis of this song data and supplied to the amplifier 50. The singer then starts to sing the karaoke song to this accompaniment, thereby causing the input voice signal Sv to be output from the microphone 1. The deterministic components of this input voice signal Sv are detected successively by the peak detecting section 3, a frame by frame. For example, sampling results as illustrated in part (1) of FIG. 6 are obtained. FIG. 6 shows the signal obtained for a single frame. For each frame, continuation is created between partial components and these are separated by the separating section 10 and divided into frequency values and amplitude values, as illustrated in part (2) and (3) of FIG. 6. Furthermore, the frequency values are normalized by the pitch normalizing section 12 to give the values shown in part (4) of FIG. 6. The amplitude values are similarly normalized to give the values shown in part (5) of FIG. 6. The normalized amplitude values illustrated in part (5) of FIG. 6 are combined with the normalized amplitude values of the target voice as shown in part (6) to give modulated amplitude values as shown in part (8). The ratio of this combination is determined by the control parameter γ.

Meanwhile, the frequency values shown in part (4) of FIG. 6 are combined with the target pitch information PTo and the fluctuation component PTf to give the modulated frequency values shown in part (7) of FIG. 6. The ratio of this combination is determined by the control parameters α and β. The frequency values and the amplitude values shown in parts (7) and (8) of FIG. 6 are combined by the mixing section 40, thereby yielding new deterministic components as illustrated in part (9) of FIG. 6. These new deterministic components are formed into a synthetic output voice signal by the interpolating and waveform generating section 41, and this output voice signal is mixed with the residual components Srd and output to the amplifier 50. As a result of the above, the singer's voice is output with the karaoke accompaniment, but the characteristics of the voice, the manner of singing, and the like, are significantly affected or influenced by the target voice. If the control parameters α,β and γ are set to values of 1, the voice characteristics and singing manner of the target are adopted completely. In this way, singing which imitates the target precisely is output.

As described above, the inventive voice converting method converts an input voice signal Sv into an output voice signal according to a reference voice signal or target voice signal. In one aspect, the inventive method is comprised of the steps of extracting a plurality of sinusoidal wave components (Fn and An) from the input voice signal Sv, memorizing pitch information (PTo and PTf) representative of a pitch of the reference voice signal, modulating a frequency Fn of each sinusoidal wave component according to the memorized pitch information, mixing the plurality of the sinusoidal wave components having the modulated frequencies to synthesize the output voice signal having a pitch different from that of the input voice signal and influenced by that of the reference voice signal. In another aspect, the inventive method is comprised of the steps of extracting a plurality of sinusoidal wave components from the input voice signal Sv, memorizing amplitude information AT representative of amplitudes of sinusoidal wave components contained in the reference voice signal, modulating an amplitude An of each sinusoidal wave component extracted from the input voice signal Sv according to the memorized amplitude information, and mixing the plurality of the sinusoidal wave components having the modulated amplitudes to synthesize the output voice signal having a voice characteristic or timbre different from that of the input voice signal Sv and influenced by that of the reference voice signal.

Figure 8:
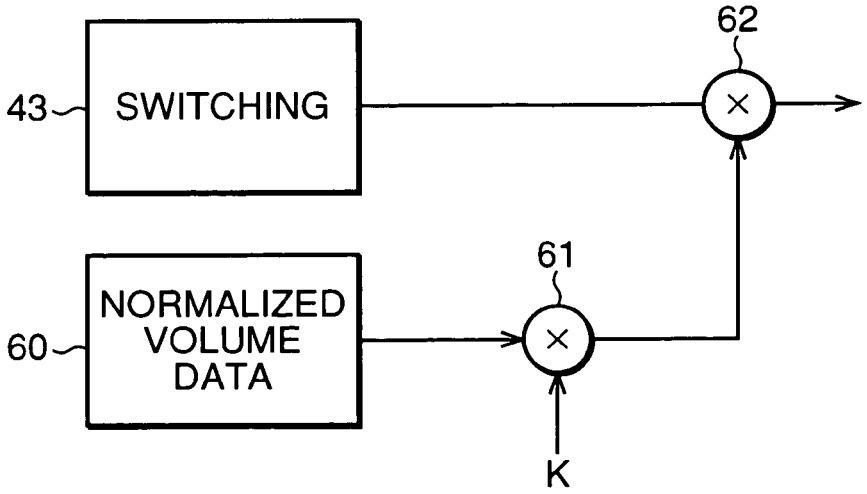
FIG. 8 is a block diagram showing the composition of a modification of the embodiment.

Modifications (1) As shown in FIG. 8, a normalized volume data storing section 60 is provided for storing normalized volume data indicating changes in the volume of the target voice. The normalized volume data read out from the normalized volume data storing section 60 is multiplied by a control parameter k at a multiplier 61, and is then multiplied at a further multiplier 62 with the synthesized waveform output from the switching section 43. By adopting the foregoing composition, it is even possible to imitate precisely the intonation of the target singing voice. The degree to which the intonation is imitated in this case is determined by the value of the control parameter k. Therefore, the parameter k should be set according to the degree of imitation desired by the user.

(2) In the present embodiment, the presence or absence of a pitch in a subject frame is determined by the pitch detecting section 11. However, detection of pitch presence is not limited to this, and may also be determined directly from the state of the input voice signal Sv.

(3) Detection of sinusoidal wave components is not limited to the method used in the present embodiment. Other methods might be possible to detect sinusoidal waves contained in the voice signal.

(4) In the present embodiment, the target pitch and deterministic amplitude components are recorded. Alternatively, it is possible to record the actual voice of the target and then to read it out and extract the pitch and deterministic amplitude components by real-time processing. In other words, processing similar to that carried out on the voice of the singer in the present embodiment may also be applied to the voice of the target.

(5) In the present embodiment, both the musical pitch and the fluctuation component of the target are used in processing, but it is possible to use musical pitch alone. Moreover, it is also possible to create and use pitch data which combines the musical pitch and fluctuation component.

(6) In the present embodiment, both the frequency and amplitude of the deterministic components of the singer's voice signal are converted, but it is also possible to convert either frequency or amplitude alone.

(7) In the present embodiment, a so-called oscillator system is adopted which uses an oscillating device for the interpolating and waveform generating section 5 or 41. Besides this, it is also possible to use a reverse FFT, for example.

Figure 9:
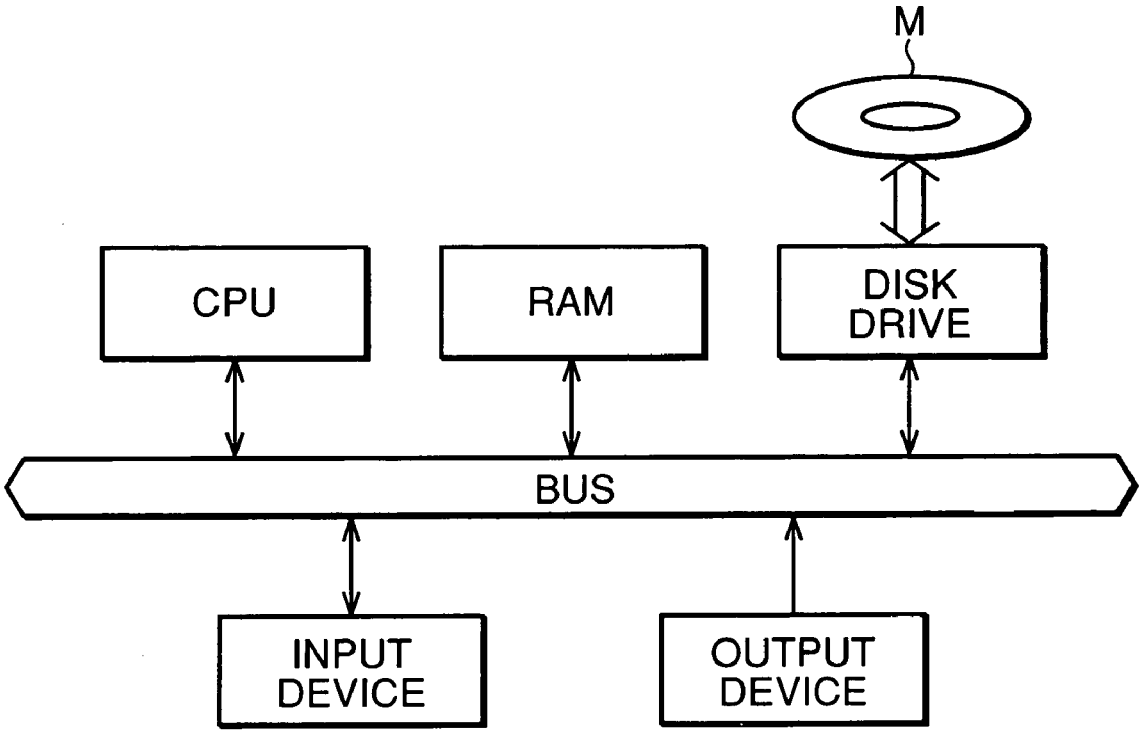
FIG. 9 is a block diagram showing a computer machine used to implement the inventive voice converter.

(8) The inventive voice converter may be implemented by a general computer machine as shown in FIG. 9. The computer machine is comprised of a CPU, a RAM, a disk drive for accessing a machine readable medium M such as a floppy disk or CO-ROM, an input device including a microphone, a keyboard and a mouse tool, and an output device including a loudspeaker and a display. The machine readable medium M is used in the computer machine having the CPU for synthesizing an output voice signal from an input voice signal and a reference voice signal. The medium M contains program instructions executable by the CPU for causing the computer machine to perform the method comprising the steps of analyzing a plurality of sinusoidal wave components contained in the input voice signal to derive a parameter set of an original frequency and an original amplitude representing each sinusoidal wave component, providing reference information characteristic of the reference voice signal, modulating the parameter set of each sinusoidal wave component according to the reference information, regenerating each of the sinusoidal wave components according to each of the modulated parameter sets so that at least one of the frequency and the amplitude of each regenerated sinusoidal wave component varies from original one, and mixing the regenerated sinusoidal wave components altogether to synthesize the output voice signal.

As described above, according to the present invention, it is possible to convert a voice such that it imitates the voice characteristics and singing manner of a target voice.

What is claimed is:

1. An apparatus for converting an input voice signal into an output voice signal according to a reference voice signal, the apparatus comprising:

extracting means for extracting only deterministic components from the input voice signal, the deterministic components including a plurality of sinusoidal wave components which are numbered sequentially, wherein the input voice signal includes the deterministic components and residual components;

separating means for separating the sinusoidal wave components into frequency value coordinates and amplitude value coordinates which are numbered sequentially in a manner the same as the sinusoidal wave components;

memory means for storing reference pitch information representative of a pitch of the reference voice signal, the pitch information including primary pitch information representative of a discrete pitch matching a music scale and secondary pitch information representative of a fractional pitch fluctuating relative to the discrete pitch, and storing reference amplitude information representative of reference amplitude value coordinates, which are numbered sequentially, of the sinusoidal wave components contained in the reference voice signal;

first modulating means for modulating the frequency value coordinates of the sinusoidal wave components of the input voice signal according to the primary reference pitch information retrieved from the memory means, to generate modulated frequency value coordinates, the first modulating means further modulating the modulated frequency value coordinates of the sinusoidal wave components of the input voice signal according to the secondary reference pitch information retrieved from the memory means, to generate further modulated frequency value coordinates;

control means for setting control parameters effective to control degrees of the modulation of the frequency value coordinates by the primary reference pitch information and the secondary pitch information, respectively, so that a degree of influence of the pitch of the reference voice signal to a pitch of the output voice signal is determined according to the control parameters;

second modulating means for modulating the amplitude value coordinates of the sinusoidal wave components of the input voice signal according to the reference amplitude information representative of the reference amplitude value coordinates which are numbered correspondingly to the amplitude value coordinates of the input voice signal, retrieved from the memory means, such that each amplitude value coordinate of the input voice signal is mixed with the corresponding reference amplitude value coordinate by a set ratio;

combining means for combining each of the modulated frequency value coordinates and each of the further modulated amplitude value coordinates to synthesize sinusoidal wave components of the output voice signal having an output pitch and an output timbre different from an input pitch and an input timbre of the input voice signal, and influenced by a reference pitch and a reference timbre of the reference voice signal; and mixing means for mixing the synthesized sinusoidal wave components having the modulated frequency value coordinates to synthesize the output voice signal having a pitch different from that of the input voice signal and influenced by the pitch of the reference voice signal.

2. The apparatus as claimed in claim 1, further comprising control means for setting a control parameter effective to control a degree of modulation of the frequency of each sinusoidal wave component by the modulating means so that a degree of influence of the pitch of the reference voice signal to the pitch of the output voice signal is determined according to the control parameter.

3. The apparatus as claimed in claim 1, further comprising detecting means for detecting a pitch of the input voice signal based on results of extraction of the sinusoidal wave components, and switch means operative when the detecting means does not detect the pitch from the input voice signal for outputting an original of the input voice signal in place of the synthesized output voice signal.

4. The apparatus as claimed in claim 1, wherein the mixing means mixes the plurality of the sinusoidal wave components having the modulated amplitudes to synthesize the output voice signal having a timbre different from that of the input voice signal and influenced by the timbre of the reference voice signal.

5. The apparatus as claimed in claim 4, further comprising means for setting a control parameter effective to control a degree of modulation of the amplitude of each sinusoidal wave component by the modulating means so that a degree of influence of the timbre of the reference voice signal to the timbre of the output voice signal is determined according to the control parameter.

6. The apparatus as claimed in claim 1, further comprising means for memorizing volume information representative of a volume variation of the reference voice signal, and means for varying a volume of the output voice signal according to the volume information so that the output voice signal emulates the volume variation of the reference voice signal.

7. The apparatus as claimed in claim 1, further comprising means for separating a residual component from the input voice signal after extraction of the sinusoidal wave components, and means for adding the residual component to the output voice signal.

8. The apparatus as claimed in claim 1, wherein the extracting means utilizes Fast Fourier Transform and a peak detecting means to extract the plurality of sinusoidal components from the input voice signal, the Fast Fourier Transform being carried in prescribed frame units to create a frequency spectrum successively for each frame of the input voice signal, the peak detecting means detecting peaks in the frequency spectrum to extract the frequency value coordinates.

9. The apparatus according to claim 1, wherein the deterministic components include peak values of the input voice signal in a frequency spectrum.

10. The apparatus according to claim 1, wherein the residual components include deviation components between a synthetic voice signal and the input voice signal.

11. An apparatus for converting an input voice signal into an output voice signal according to a reference voice signal, the apparatus comprising:

extracting means for extracting only deterministic components from the input voice signal, the deterministic components including a plurality of sinusoidal wave components which are numbered sequentially, wherein the input voice signal includes the deterministic components and residual components;

separating means for separating the sinusoidal wave components into frequency value coordinates and amplitude value coordinates ASn' (n =1, 2, 3, . . . );

memory means for storing, as memorized amplitude value coordinates, reference amplitude information representative of reference amplitude value coordinates ATn (n =1, 2, 3, . . . ), which are numbered sequentially, of the sinusoidal wave components contained in the reference voice signal;

modulating means for modulating the amplitude value coordinates ASn' of the sinusoidal wave components of the input voice signal extracted from the input voice signal according to the reference amplitude information representative of the reference amplitude value coordinates ATn, which are numbered correspondingly to the amplitude value coordinates of the input voice signal, and retrieved from the memory means by the following calculation $(1-\gamma) * ASn' + \gamma * ATn$ (n=1, 2, 3, . . . ), where the parameter $\gamma$ takes a value from zero to one and represents a degree of mixing; and mixing means for mixing the plurality of the sinusoidal wave components having the modulated amplitude value coordinates to synthesize the output voice signal having a timbre different from that of the input voice signal and influenced by the timbre of the reference voice signal, wherein the modulating means comprises normalizing means for normalizing the amplitude value coordinates of the sinusoidal wave components of the input voice signal by a mean amplitude of the input voice signal, to generate normalized amplitude value coordinates, a second mixing means for mixing the normalized amplitude value coordinates of the input voice signal and the memorized amplitude value coordinates of the reference voice signal with one another by a predetermined ratio to produce mixed amplitude value coordinates, and multiplying means for multiplying the normalized amplitude value coordinates of the sinusoidal wave components of the input voice signal with the mean amplitude of the input voice signal.

12. The apparatus as claimed in claim 11, further comprising control means for setting a control parameter effective to control a degree of modulation of the amplitude of each sinusoidal wave component by the modulating means so that a degree of influence of the timbre of the reference voice signal to the timbre of the output voice signal is determined according to the control parameter.

13. The apparatus as claimed in claim 11, wherein the memory means further stores pitch information representative of a pitch of the reference voice signal, and the modulating means further modulates a frequency of each sinusoidal wave component of the input voice signal according to the pitch information, so that the mixing means mixes the plurality of the sinusoidal wave components having the modulated frequencies to synthesize the output voice signal having a pitch different from that of the input voice signal and influenced by the pitch of the reference voice signal.

14. The apparatus as claimed in claim 13, further comprising means for setting a control parameter effective to control a degree of modulation of the frequency of each sinusoidal wave component by the modulating means so that a degree of influence of the pitch of the reference voice signal to the pitch of the output voice signal is determined according to the control parameter.

15. The apparatus as claimed in claim 11, further comprising detecting means for detecting a pitch of the input voice signal based on results of extraction of the sinusoidal wave components, and switch means operative when the detecting means does not detect the pitch from the input voice signal for outputting an original of the input voice signal in place of the synthesized output voice signal.

16. The apparatus as claimed in claim 11, further comprising means for memorizing volume information representative of a volume variation of the reference voice signal, and means for varying a volume of the output voice signal according to the volume information so that the output voice signal emulates the volume variation of the reference voice signal.

17. The apparatus as claimed in claim 11, further comprising means for separating a residual component from the input voice signal after extraction of the sinusoidal wave components, and means for adding the residual component to the output voice signal.

18. The apparatus claimed In claim 11, wherein the extracting means utilizes Fast Fourier Transform and a peak detecting means to extract the plurality of sinusoidal component from the input voice signal, the Fast Fourier Transform being carded inprescribed frame units to create a frequency spectrum successively for each frame of the Input voice signal, the peak detecting means detecting peaks in the frequency spectrum to extract the amplitude value coordinates.

19. The apparatus according to claim 11, wherein the deterministic components include peak values of the input voice signal in a frequency spectrum.

20. The apparatus according to claim 11, wherein the residual components include deviation components between a synthetic voice signal and the input voice signal.

21. An apparatus for synthesizing an output voice signal from an input voice signal and a reference voice signal, the apparatus comprising:

an analyzer device that analyzes only deterministic components contained in the input voice signal to derive a parameter set of an original frequency and an original amplitude, the deterministic components including a plurality of sinusoidal wave components which are numbered sequentially, wherein the input voice signal includes the deterministic components and residual components;

a separating device to separate the sinusoidal wave components into frequency value coordinates and amplitude value coordinates ASn' (n =1, 2, 3, . . . ), which are numbered sequentially in a manner the same as the sinusoidal wave components;

a source device that provides reference information characteristic of the reference voice signal, the reference information being reference amplitude information representative of reference amplitude value coordinates ATn (n=1, 2, 3, . . . ), which are numbered sequentially;

a modulator device that modulates the parameter set of the sinusoidal wave components according to the reference information;

a regenerator device that operates according to each of the parameter sets as modulated to regenerate each of the sinusoidal wave components so that at least one of the frequency and the amplitude of each sinusoidal wave component as regenerated varies from the original one, and that mixes the regenerated sinusoidal wave components together to synthesize the output voice signal;

a second modulator device to modulate the amplitude value coordinates ASn' of the sinusoidal wave components of the input voice signal according to reference amplitude information, representative of amplitudes of the sinusoidal wave components contained in the reference voice signal ATn which are numbered correspondingly to the amplitude value coordinates of the input voice signal, to generate modulated amplitude value coordinates by utilizing the following calculation $(1-\gamma)*ASn'+\gamma*ATn$ (n=1, 2, 3, . . . ), where the parameter $\gamma$ takes a value from zero to one and represents a degree of mixing;

a combining device to combine the modulated frequency value coordinates and the modulated amplitude value coordinates to synthesize sinusoidal wave components of the output voice signal having an output pitch and an output timbre different from an input pitch and an input timbre of the input voice signal, and influenced by a reference pitch and a reference timbre of the reference voice signal.

22. The apparatus as claimed in claim 21, wherein the source device provides the reference information characteristic of a pitch of the reference voice signal, and wherein the modulator device modulates the parameter set of each sinusoidal wave component according to the reference information so that the frequency of each sinusoidal wave component as regenerated varies from the original frequency, the pitch of the output voice signal being synthesized according to the pitch of the reference voice signal.

23. The apparatus as claimed in claim 21, wherein the source device provides the reference information characteristic of a timbre of the reference voice signal, and wherein the modulator device modulates the parameter set of each sinusoidal wave component according to the reference information so that the amplitude of each sinusoidal wave component as regenerated varies from the original amplitude, the timbre of the output voice signal being synthesized according to the timbre of the reference voice signal.

24. The apparatus as claimed in claim 21, further comprising a control device that provides a control parameter effective to control the modulator device so that a degree of modulation of the parameter set is variably determined according to the control parameter.

25. The apparatus as claimed in claim 21, further comprising a detector device that detects a pitch of the input voice signal based on analysis of the sinusoidal wave components by the analyzer device, and a switch device operative when the detector device does not detect the pitch from the input voice signal for outputting an original of the input voice signal in place of the synthesized output voice signal.

26. The apparatus as claimed in claim 21, further comprising a memory device that stores volume information representative of a volume variation of the reference voice signal, and a volume device that varies a volume of the output voice signal according to the volume information so that the output voice signal emulates the volume variation of the reference voice signal.

27. The apparatus as claimed in claim 21, further comprising a separator device that separates a residual component other than the sinusoidal wave components from the input voice signal, and an adder device that adds the residual component to the output voice signal.

28. The apparatus as claimed in claim 21, wherein the parameter set is in the form of a plurality of frequency value and amplitude value coordinates, the frequency value coordinates representing the original frequency and the amplitude value coordinates representing the original amplitude.

29. The apparatus as claimed in claim 21, wherein the analyzer device utilizes Fast Fourier Transform and a peak detecting means to derive the parameter set representing the corresponding sinusoidal wave component, the Fast Fourier Transform being carded In prescribed frame units to create a frequency spectrum successively for each frame of the input voice signal, the peak detecting means detecting peaks In the frequency spectrum to extract the parameter set.

30. The apparatus according to claim 21, wherein the deterministic components include peak values of the input voice signal in a frequency spectrum.

31. The apparatus according to claim 21, wherein the residual components include deviation components between a synthetic voice signal and the input voice signal.

32. A method of converting an input voice signal into an output voice signal according to a reference voice signal, the method comprising the steps of:

extracting only deterministic components from the input voice signal, the deterministic components including a plurality of sinusoidal wave components which are numbered sequentially, wherein the input voice signal includes the deterministic components and residual components;

separating the sinusoidal wave components into frequency value coordinates and amplitude value coordinates, which are numbered sequentially in a manner the same as the sinusoidal wave components;

storing reference pitch information representative of a pitch of the reference voice signal, the pitch information including primary pitch information representative of a discrete pitch matching a music scale and secondary pitch information representative of a fractional pitch fluctuating relative to the discrete pitch, and storing reference amplitude information representative of reference amplitude value coordinates, which are numbered sequentially, of the sinusoidal wave components contained in the reference voice signal;

modulating the frequency value coordinates of the sinusoidal wave components of the input voice signal according to the primary reference pitch information, to generate modulated amplitude value coordinates, and further modulating the modulated frequency value coordinates of the sinusoidal wave components of the input voice signal according to the secondary reference pitch information retrieved from the memory means, to generate further modulated frequency value coordinates;

setting control parameters effective to control degrees of modulation of the frequency value coordinates by the primary reference pitch information and the secondary pitch information, respectively, so that a degree of influence of the pitch of the reference signal to a pitch of the output voice signal is determined according to the control parameters;

mixing the plurality of the sinusoidal wave components having the modulated frequency value coordinates to synthesize the output voice signal having a pitch different from that of the input voice signal and influenced by that of the reference voice signal;

modulating the amplitude value coordinates of the sinusoidal wave components of the input voice signal according to the reference amplitude information representative of the reference amplitude value coordinates which are numbered correspondingly to the amplitude value coordinates of the input voice signal, retrieved from the memory means such that each amplitude value coordinate of the input voice signal is mixed with the corresponding reference amplitude value coordinate by a set ratio; and combining the modulated frequency value coordinates and the modulated amplitude value coordinates to synthesize sinusoidal wave components of the output voice signal having an output pitch and an output timbre different from an input pitch and an input timbre of the input voice signal, and influenced by a reference pitch and a reference timbre of the reference voice signal.

33. The method as claimed in claim 32, wherein the extracting step involves utilizing Fast Fourier Transform and peak detection to extract the plurally of sinusoidal components from the input voice signal, the Fast Fourier Transform being carried in prescribed frame units to create a frequency spectrum successively for each frame of the input voice signal, the peak detection detecting peaks In the frequency spectrum to extract the frequency value coordinates.

34. The method according to claim 32, wherein the deterministic components include peak values of the input voice signal in a frequency spectrum.

35. The method according to claim 32, wherein the residual components include deviation components between a synthetic voice signal and the input voice signal.

36. A method of converting an input voice signal into an output voice signal according to a reference voice signal, the method comprising the steps of:

extracting only deterministic components from the input voice signal, the deterministic components including a plurality of sinusoidal wave components which are numbered sequentially, wherein the input voice signal includes the deterministic components and residual components;

separating the sinusoidal wave components into frequency value coordinates and amplitude value coordinates ASn' (n=1, 2, 3, . . . );

storing, as stored amplitude value coordinates, reference amplitude information representative of reference amplitude value coordinates ATn (n=1, 2, 3, . . . ), which are numbered sequentially in a manner the same as the sinusoidal wave components, of the sinusoidal wave components contained in the reference voice signal;

modulating the amplitude value coordinates ASn' of the sinusoidal wave components of the input voice signal extracted from the input voice signal according to the reference amplitude information representative of the reference amplitude value coordinates ATn, by the following calculation $(1-\gamma) * ASn' + \gamma * ATn$ (n=1, 2, 3, . . . ), where the parameter $\gamma$ takes a value from zero to one and represents a degree of mixing, which are numbered correspondingly to the amplitude value coordinates of the input voice signal such that each amplitude value coordinate of the input voice signal is mixed with the corresponding reference amplitude coordinate by a set ratio, retrieved from the memory means; and mixing the plurality of the sinusoidal wave components having the modulated amplitude value coordinates to synthesize the output vice signal having a timbre different from that of the input voice signal and influenced by the timbre of the reference voice signal;

normalizing the amplitude value coordinates of the sinusoidal wave components of the input voice signal by a mean amplitude of the input voice signal, to generate normalized amplitude value coordinates;

mixing the normalized amplitude value coordinates of the input voice signal and the stored amplitude value coordinates of the reference voice signal with one another by a predetermined ratio to produce mixed amplitude value coordinates; and multiplying the normalized amplitude value coordinates of the sinusoidal wave components of the input voice signal with the mean amplitude of the input voice signal.

37. The method as claimed in claim 36, wherein the extracting step involves utilizing Fast Fourier Transform and peak detection to extract the plurally of sinusoidal components from the input voice signal, the Fast Fourier Transform being carried In prescribed frame units to create a frequency spectrum successively for each frame of the input voice signal, the peak detection detecting peaks in the frequency spectrum to extract the amplitude value coordinates.

38. The method according to claim 36, wherein the deterministic components include peak values of the input voice signal in a frequency spectrum.

39. The method according to claim 36, wherein the residual components include deviation components between a synthetic voice signal and the input voice signal.

40. A machine readable medium used in a computer machine having a CPU for synthesizing an output voice signal from an input voice signal, the medium containing program instructions executed by the CPU for causing the computer machine to perform the method comprising the steps of:

analyzing only deterministic components contained in the input voice signal to derive a parameter set of an original frequency and an original amplitude, the deterministic components including a plurality of sinusoidal wave components which are numbered sequentially, wherein the input voice signal includes the deterministic components and residual components;

separating means for separating the sinusoidal wave components into frequency value coordinates and amplitude value coordinates ASn' (n=1, 2, 3, . . . ); providing reference information characteristic of the reference voice signal, including reference amplitude information representative of amplitude value coordinates ATn (n=1, 2, 3, . . . );

modulating the amplitude value coordinates ASn' according to the reference amplitude information representative of the amplitude value coordinates ATn by the following calculation $(1-\gamma) * ASn' + \gamma * ATn$ (n=1, 2, 3, . . . ), where the parameter $\gamma$ takes a value from zero to one and represents a degree of mixing, to generate modulated amplitude value coordinates;

regenerating each of the sinusoidal wave components according to each of the modulated parameter sets so that at least one of the frequency and the amplitude of each regenerated sinusoidal wave components varies from the original one, and mixing the regenerated sinusoidal wave components together to synthesize the output voice signal;

separating the sinusoidal wave components into frequency value coordinates and amplitude value coordinates, which are numbered sequentially in a manner the same as the sinusoidal wave components;

modulating the amplitude value coordinates of the sinusoidal wave components of the input voice signal according to the reference amplitude information, representative of reference amplitude value coordinates which are numbered correspondingly to the amplitude value coordinates of the input voice signal such that each amplitude value coordinate of the input voice signal is mixed with the corresponding reference amplitude value coordinate by a set ratio, of the sinusoidal wave components contained in the reference voice signal, to generate modulated amplitude value coordinates; and combining the modulated frequency value coordinates and the modulated amplitude value coordinates to synthesize sinusoidal wave components of the output voice signal having an output pitch and an output timbre different from an input pitch and an input timbre of the input voice signal, and influenced by a reference pitch and a reference timbre of the reference voice signal.

41. The machine readable medium as claimed in claim 40, wherein the parameter set is in the form of a plurality of frequency value and amplitude value coordinates, the frequency value coordinates representing the original frequency and the amplitude value coordinates representing the original amplitude. detecting peaks In the frequency spectrum to extract the frequency value coordinates.

42. The machine readable medium as claimed in claim 40, wherein the analyzing step involves utilizing Fast Fourier Transform and peak detection to derive the parameter set representing the corresponding sinusoidal wave component, the Fast Fourier Transform being carried in prescribed frame units to create a frequency spectrum successively for each frame of the input voice signal, the peak detection detecting peaks in the frequency spectrum to extract the parameter set.

43. The machine-readable medium according to claim 40, wherein the deterministic components include peak values of the input voice signal in a frequency spectrum.

44. The machine-readable medium according to claim 40, wherein the residual components include deviation components between a synthetic voice signal and the input voice signal.

45. An apparatus for converting an input voice signal into an output voice signal according to a reference voice signal, the apparatus comprising:

extracting means for extracting only deterministic components from the input voice signal, the deterministic components including a plurality of sinusoidal wave components which are numbered sequentially, wherein the input voice signal includes the deterministic components and residual components;

separating means for separating the sinusoidal wave components into frequency value coordinates and amplitude value coordinates which are numbered sequentially in a manner the same as the sinusoidal wave components;

memory means for storing reference pitch information representative of a pitch of the reference voice signal, and reference amplitude information representative of reference amplitude value coordinates, which are numbered sequentially, of the sinusoidal wave components contained in the reference voice signal;

first modulating means for modulating the frequency value coordinates of the sinusoidal wave components of the input voice signal according to the reference pitch information retrieved from the memory means, to generate modulated frequency value coordinates;

second modulating means for modulating the amplitude value coordinates of the sinusoidal wave components of the input voice signal according to the reference amplitude information representative of the reference amplitude value coordinates which are numbered correspondingly to the amplitude value coordinates of the input voice signal, retrieved from the memory means, such that each amplitude value coordinate of the input voice signal is mixed with the corresponding reference amplitude value coordinate by a set ratio;

combining means for combining each of the modulated frequency value coordinates and each of the modulated amplitude value coordinates, which are processed separately from each other and which are numbered correspondingly to each other, to synthesize sinusoidal wave components of the output voice signal having an output pitch and an output timbre different from an input pitch and an input timbre of the input voice signal, and influenced by a reference pitch and a reference timbre of the reference voice signal; and mixing means for mixing the synthesized sinusoidal wave components having the modulated frequency value coordinates to synthesize the output voice signal having a pitch different from that of the input voice signal and influenced by the pitch of the reference voice signal.

46. An apparatus for converting an input voice signal into an output voice signal according to a reference voice signal, the apparatus comprising:

extracting means for extracting only deterministic components from the input voice signal, the deterministic components including a plurality of sinusoidal wave components which are numbered sequentially, wherein the input voice signal includes the deterministic components and residual components;

separating means for separating the sinusoidal wave components into frequency value coordinates and amplitude value coordinates ASn' (n=1, 2, 3, . . . );

memory means for storing reference pitch information representative of a pitch of the reference voice signal, and reference amplitude information representative of reference amplitude value coordinates ATn (n=1, 2, 3, . . . ) of the sinusoidal wave components contained in the reference voice signal;

first modulating means for modulating the frequency value coordinates of the sinusoidal wave components of the input voice signal according to the reference pitch information retrieved from the memory means, to generate modulated frequency value coordinates;

second modulating means for modulating the amplitude value coordinates ASn' of the sinusoidal wave components of the input voice signal according to the reference amplitude information representative of the reference amplitude value coordinates representative of the amplitude value coordinates ATn retrieved from the memory means by the following calculation $(1-\gamma) * ASn'+\gamma*ATn$ (n=1, 2, 3, . . . ), where the parameter $\gamma$ takes a value from zero to one and represents a degree of mixing;

combining means for combining each of the modulated frequency value coordinates and each of the modulated amplitude value coordinates, which are processed separately from each other and which are numbered correspondingly to each other, to synthesize sinusoidal wave components of the output voice signal having an output pitch and an output timbre different from an input pitch and an input timbre of the input voice signal, and influenced by a reference pitch and a reference timbre of the reference voice signal; and mixing means for mixing the synthesized sinusoidal wave components having the modulated frequency value coordinates to synthesize the output voice signal having a pitch different from that of the input voice signal and influenced by the pitch of the reference voice signal.

* * * * *